US007730826B2

(12) United States Patent
Becker et al.

(10) Patent No.: US 7,730,826 B2
(45) Date of Patent: Jun. 8, 2010

(54) SWASHPLATE TYPE AXIAL PISTON DEVICE HAVING APPARATUS FOR PROVIDING THREE OPERATING DISPLACEMENTS

(75) Inventors: Aaron Becker, Ames, IA (US); Branko Joseph Horvat, Jr., Gilbert, IA (US)

(73) Assignee: Sauer-Danfoss Inc., Ames, IA (US)

( * ) Notice: Subject to any disclaimer, the term of this patent is extended or adjusted under 35 U.S.C. 154(b) by 318 days.

(21) Appl. No.: 11/831,122

(22) Filed: Jul. 31, 2007

(65) Prior Publication Data

US 2009/0031893 A1 Feb. 5, 2009

(51) Int. Cl.
*F01B 3/02* (2006.01)
*F01B 7/20* (2006.01)

(52) U.S. Cl. ..... 92/12.2; 92/52

(58) Field of Classification Search ..... 92/12.2, 92/52; 91/506
See application file for complete search history.

(56) References Cited

U.S. PATENT DOCUMENTS

| | | | | |
|---|---|---|---|---|
| 2,806,449 | A * | 9/1957 | Simmons | 92/52 |
| 2,941,480 | A * | 6/1960 | Sadler et al. | 91/506 |
| 3,256,830 | A * | 6/1966 | Budzich | 91/506 |
| 3,429,225 | A * | 2/1969 | Keyworth | 92/12.2 |
| 3,667,225 | A | 6/1972 | Karman | |
| 3,736,753 | A | 6/1973 | Roth | |
| 3,941,513 | A | 3/1976 | Malott | |
| 3,945,764 | A | 3/1976 | Marietta | |
| 4,125,059 | A * | 11/1978 | Tuji | 92/51 |
| 4,342,256 | A | 8/1982 | Andersen et al. | |
| 4,530,371 | A | 7/1985 | Arav | |
| 5,056,600 | A | 10/1991 | Surjaatmadja et al. | |
| 5,101,942 | A | 4/1992 | Pruss et al. | |
| 5,520,217 | A | 5/1996 | Grawunde | |
| 5,706,712 | A * | 1/1998 | Tischer et al. | 92/52 |
| 5,836,160 | A | 11/1998 | Chang | |
| 5,928,099 | A | 7/1999 | Tsunemi | |
| 5,992,460 | A | 11/1999 | Akimoto | |
| 6,248,037 | B1 | 6/2001 | Forster | |
| 6,425,313 | B1 * | 7/2002 | Kleinedler et al. | 92/12.2 |
| 6,443,706 | B1 | 9/2002 | Deininger et al. | |
| 6,481,333 | B1 | 11/2002 | Akasaka et al. | |
| 6,524,206 | B2 | 2/2003 | Tsunemi et al. | |
| 6,543,481 | B2 | 4/2003 | Neff et al. | |
| 6,688,417 | B2 | 2/2004 | Hansell | |
| 6,849,028 | B2 | 2/2005 | Nakatani et al. | |
| 7,008,343 | B2 | 3/2006 | Nagasugi et al. | |
| 7,047,993 | B2 | 5/2006 | Manaka et al. | |
| 2002/0014149 | A1 * | 2/2002 | Fiebing et al. | 92/12.2 |

FOREIGN PATENT DOCUMENTS

| | | |
|---|---|---|
| JP | 55002883 | 1/1980 |
| JP | 59077086 | 5/1984 |
| JP | 3078573 | 4/1991 |
| JP | 05223053 | 8/1993 |

* cited by examiner

*Primary Examiner*—F. Daniel Lopez

(57) ABSTRACT

An axial piston hydraulic device. The device has a housing that uses a servo piston in order to control the displacement of a swashplate within the device. By using a servo member disposed within a cavity of an end cap on the housing the axial piston hydraulic device is able to provide three operating positions depending on the angle of the swashplate.

8 Claims, 7 Drawing Sheets

SWASHPLATE TYPE AXIAL PISTON DEVICE HAVING APPARATUS FOR PROVIDING THREE OPERATING DISPLACEMENTS

BACKGROUND OF THE INVENTION

This invention relates to swashplate axial piston hydraulic devices. More specifically, this invention relates to an apparatus and method that provides three operating displacements in a swashplate type axial piston unit.

Present swashplate type axial piston devices comprise a housing having a cylinder block with a plurality of reciprocating pistons therein that are acted upon by a swashplate. The swashplate is connected to a servo piston that is acted upon by a servo spring. Typically, the hydraulic device is a two positioned device in which the swashplate angle is controlled by the servo piston. The maximum angle (displacement) is defined by the point at which the servo piston contacts an end cap of the housing. While the minimum angle is defined by the point at which the servo piston contacts the housing. Thus, the control input is hydraulic pressure and the total movement of the servo piston from minimum to maximum displacement is a predetermined distance. In this embodiment there is no method to control the displacement of the device between maximum or minimum.

With hydraulic technology advancing higher speeds of hydraulic units is being achieved. With greater speeds greater torque loses are experienced as a result of the increase in speed range. Additionally, displacement accuracy of the swashplate has also been diminished as higher speeds have been accomplished causing mistracking problems associated with machines such as crawlers and skidsteer loaders.

Thus, a principal object of the present invention is to provide an improved swashplate type axial piston unit that provides for improved control of the displacement of the device.

Yet another object of the present invention is to provide for multiple functionality of a swashplate type axial piston device.

These and other objects, features, or advantages of the present invention will become apparent from the specification and claims.

BRIEF SUMMARY OF THE INVENTION

An axial piston hydraulic device having a housing with a cylinder block having reciprocating pistons that are acted upon by a swashplate disposed therein. A servo piston is connected to the swashplate adjacent a first end and extends to a second end. Secured to the housing is an end cap having a cavity disposed therein. Disposed within the cavity of the end cap is a servo member that receives the servo piston to provide a plurality of operating conditions.

DETAILED DESCRIPTION OF THE PREFERRED EMBODIMENT

Figure 1:
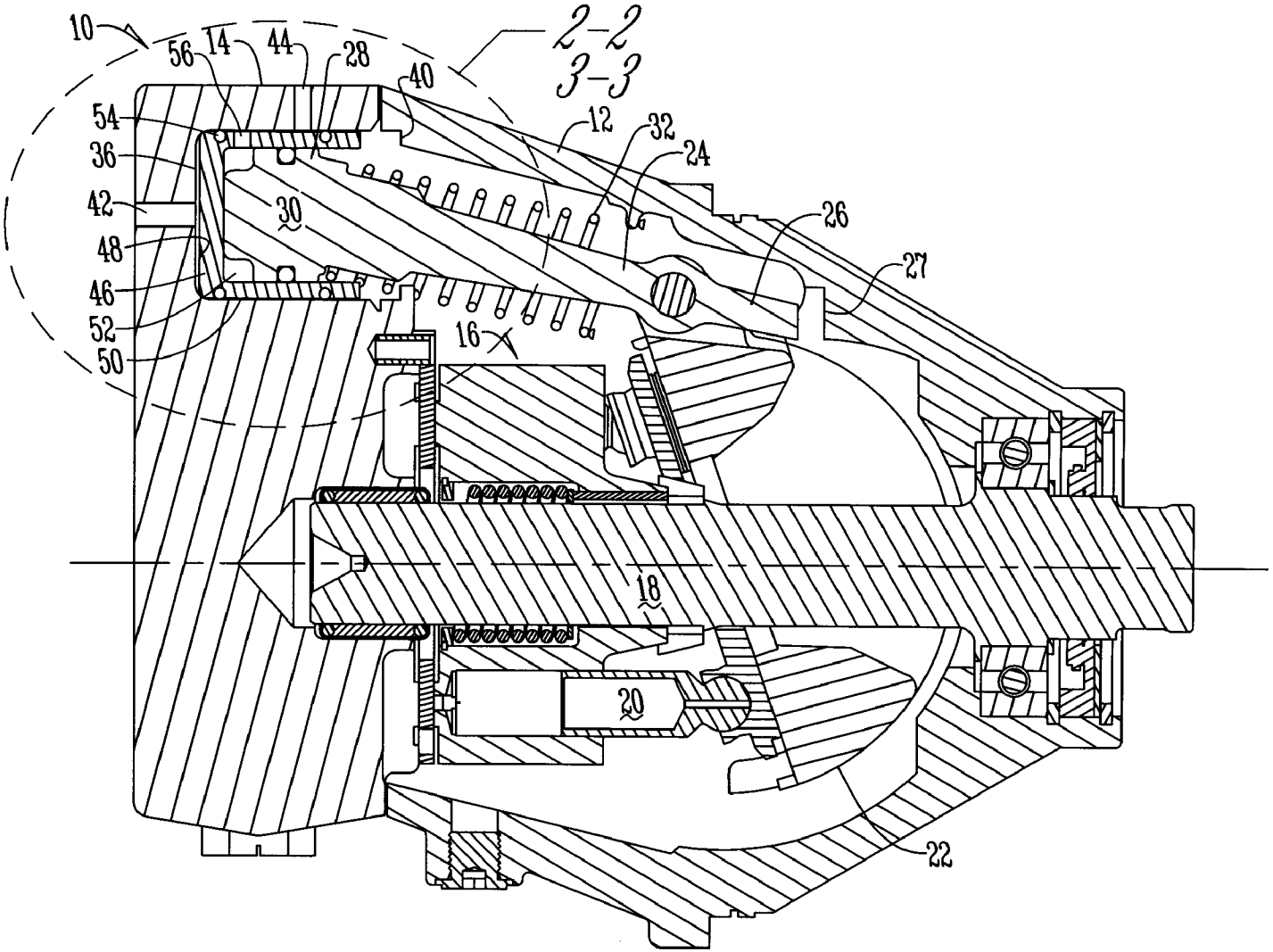
FIG. 1 is a sectional view of an axial piston hydraulic device.
Figure 2:
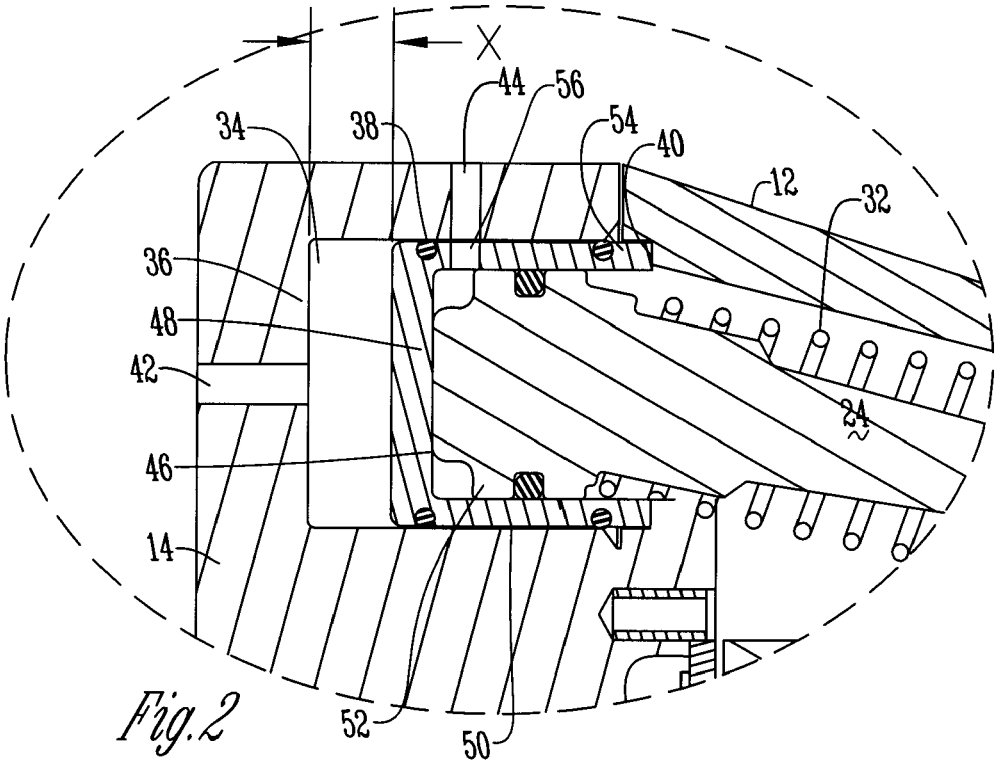
FIG. 2 is a sectional view of a servo piston in an operating condition.
Figure 3:
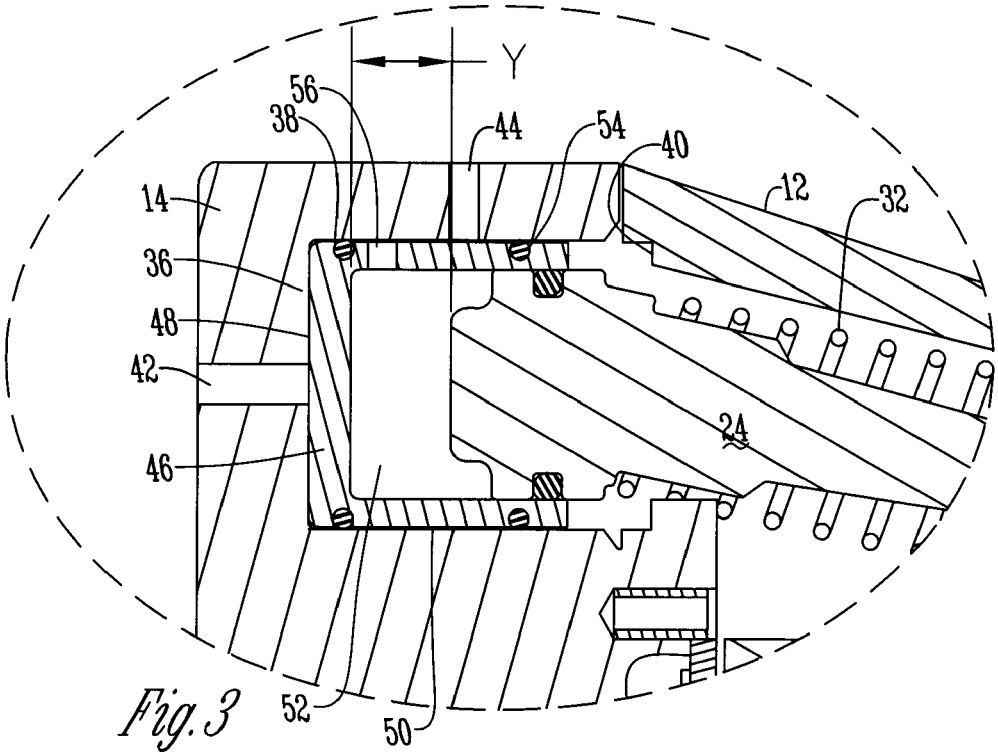
FIG. 3 is a sectional view of a servo piston in an operating condition.

FIGS. 1-3 show a first embodiment of an axial piston hydraulic device 10 having a housing 12 that is connected to an end cap 14. In this embodiment the end cap 14 is shown as detachably secured to the housing 12, however, in an alternative embodiment the end cap 14 and housing 12 could be of one-piece construction or the like.

Within housing 12 is a cylinder block 16 having an input shaft 18 disposed therethrough and having a plurality of reciprocating pistons 20 therein. The reciprocating pistons 20 are acted upon by a swashplate 22 that is connected to a servo piston 24 at a first end 26 of the servo piston 24. The housing 12 provides a stop 27 for the first end 26 of the servo piston 24.

The servo piston 24 extends from its first end 26 to a second end 28 that terminates in a servo piston head 30. Surrounding the servo piston 24 is a servo piston spring 32 that biases the servo piston head towards the end cap 14.

End cap 14 has a cavity 34 therein that has an end wall 36 and a sidewall 38 that extends into the housing 12 and terminates at a seat 40 formed within the housing 12. Additionally disposed through the end cap 14 is a first port 42 that communicates with cavity 34 to pressurize cavity 34. Additionally, a second port 44 also can provide pressure.

Disposed within the cavity 34 of the end cap 14 is a servo member 46. In the embodiment of FIGS. 1-3 the servo member 46 is a servo can having a cylindrical shape with an end wall 48 that extends into a sidewall 50 to form a cavity 52. In a first embodiment sealing rings 54 are disposed around the servo member 46 and contact the end cap 14 within the cavity 34 of the end cap 14. Specifically, the servo member 46 is moveable from between the end wall 36 of cavity 34 of the end cap 14 to the seat 40 of housing 12 wherein the sidewall 50 of the servo can 46 contacts the seat 40 of housing 12. Additionally, within sidewall 50 is a servo fill port 56 that allows fluid communication between the cavity 52 of the servo member 46 and the cavity 34 of the end cap 14.

By use of the servo member 46 the axial piston hydraulic device 10 provides a plurality of operating conditions. Specifically, as shown in FIG. 1 a first operating condition is provided when the axial piston hydraulic device 10 is in a maximum angle condition. During a maximum angle condition the servo piston 24 and servo member 46 are biased against the end cap 14 by the servo spring 32.

When in the first operating condition, as seen in FIG. 1, and the axial piston hydraulic device 10 is commanded to a "mid stroke" (between maximum and minimum angle) condition first port 42 is pressurized. As the first port 42 is pressurized, force builds between the end wall 48 of the servo member 46 and the end wall 36 of the end cap 14. Once a first threshold pressure is reached servo piston 24 and servo member 46 overcome the force of the spring 32 and move toward the swashplate 22 until the servo member 46 engages the housing 12 at seat 40. Thus, the servo member 46 moves a first distance X in response to the pressurization of the first port 42. At this time the axial piston hydraulic device 10 is considered in a second operating condition at a point between the maximum and minimum angle for the axial piston hydraulic device and is shown in FIG. 2.

To command minimum angle condition, the second port 44 of the end cap 14 is pressurized. This generates a force within the cavity 52 of the servo member 46 against the head 30 of the servo piston 24. When a second threshold pressure is reached the servo piston 24 moves until the servo piston 24 comes into contact with housing stop 27. (FIG. 3). The distance moved between the end wall 48 and piston head 30 is a second distance Y. At this point in time the axial piston hydraulic device 10 is considered in a third operating condition. Therefore, when the first distance X is less than the second distance Y the axial piston hydraulic device 10 operates in three distinct displacements or angles.

Figure 4:
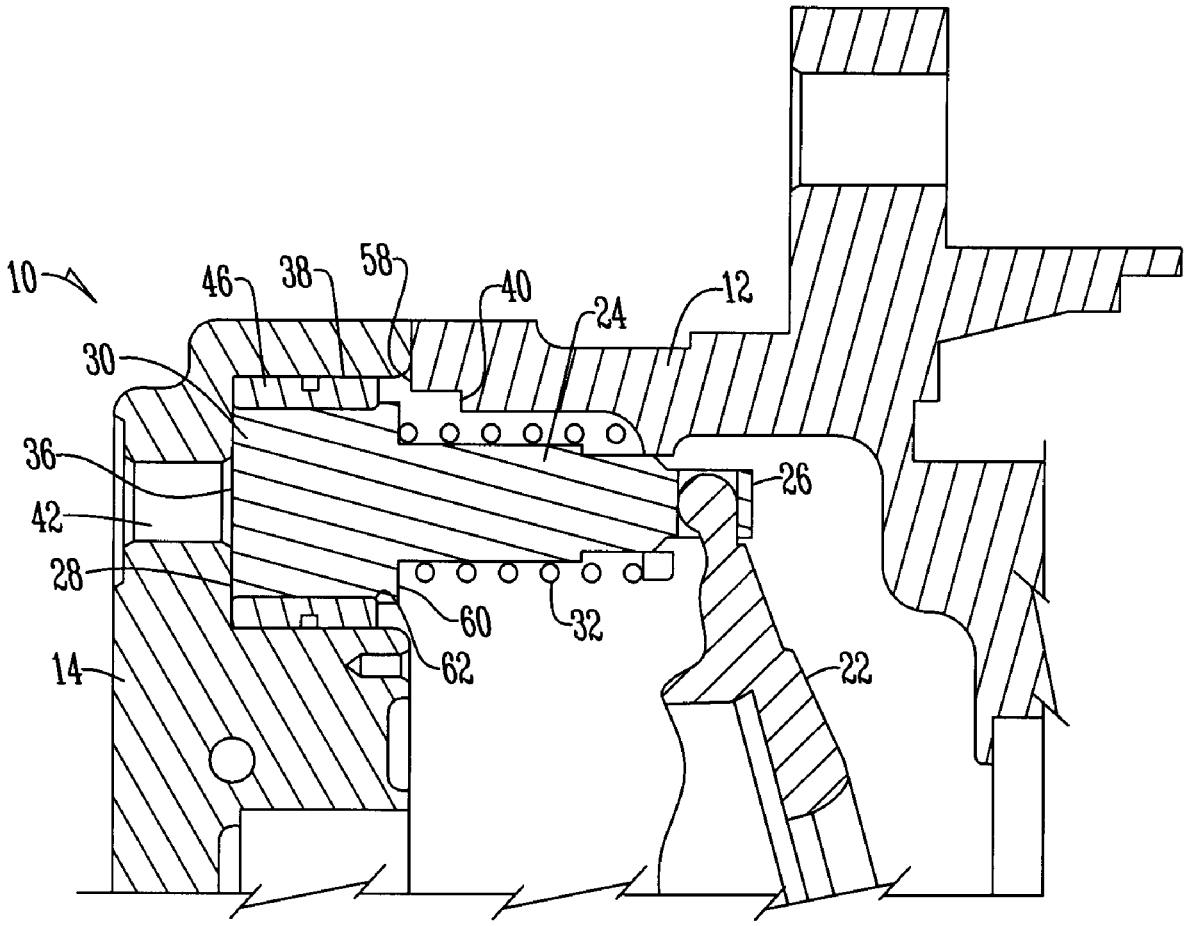
FIG. 4 is a sectional view of a servo piston in an operating condition.
Figure 5:
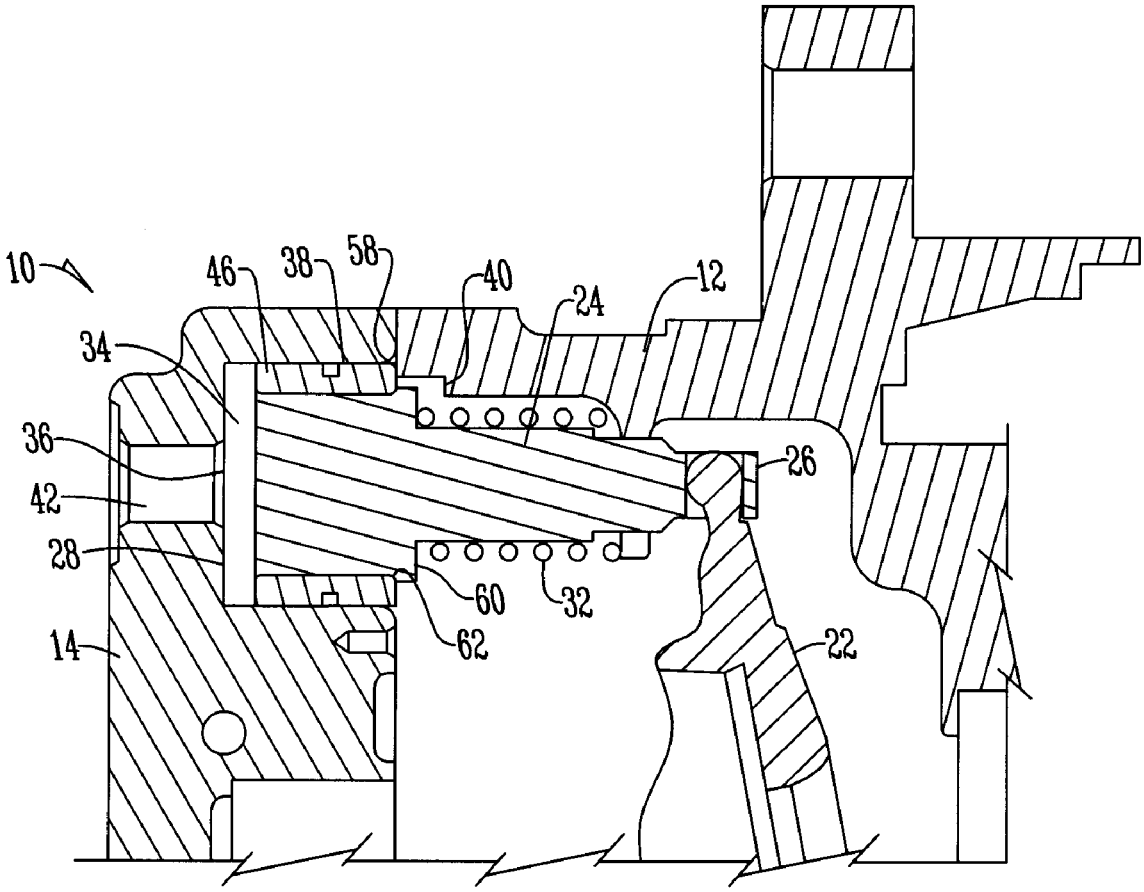
FIG. 5 is a sectional view of a servo piston in an operating condition.
Figure 6:
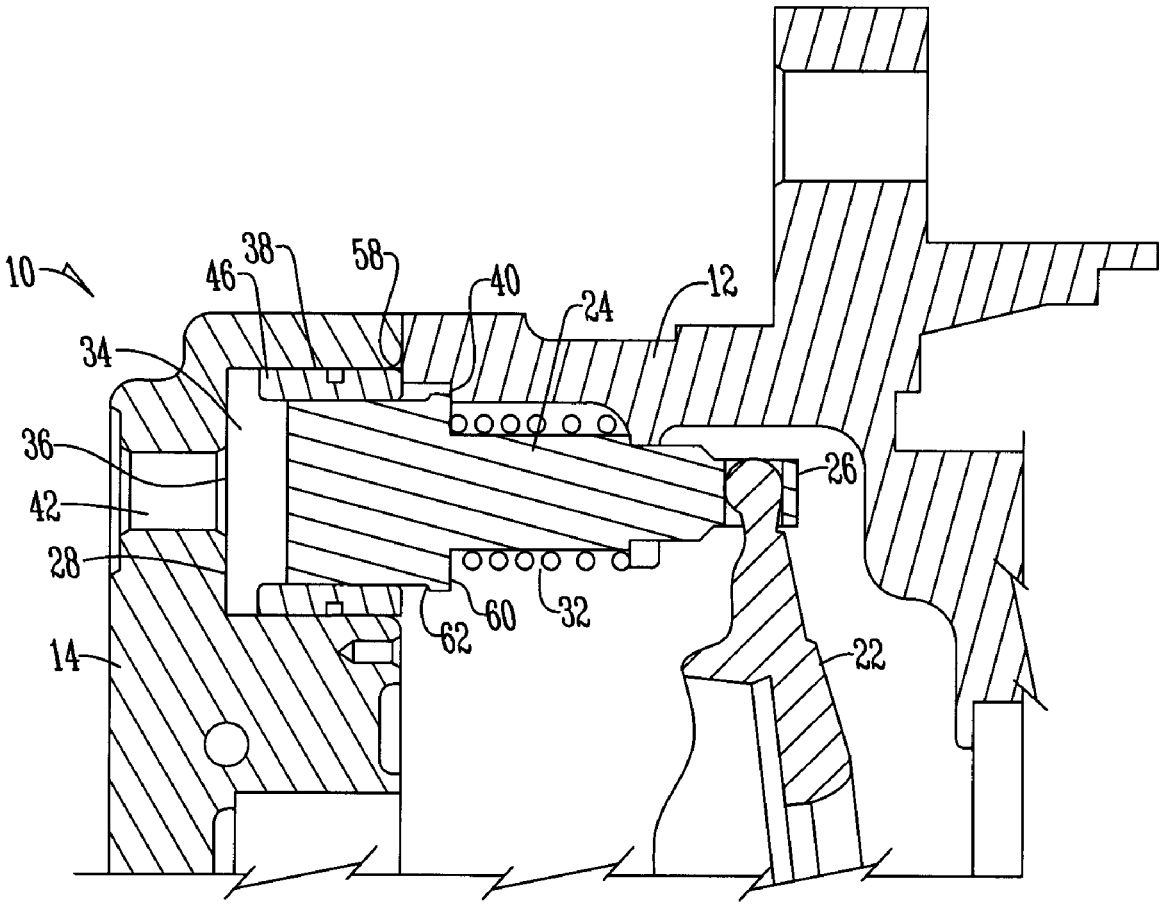
FIG. 6 is a sectional view of a servo piston in an operating condition.

A second embodiment of the hydraulic device 10 is shown in FIGS. 4-6. In FIGS. 4-6 the second port 44 is eliminated and the servo member 46 is represented by a second piston instead of a servo can. Additionally, in this embodiment the housing 12 adjacent the end cap 14 creates a second seat 58 and the head of the first servo piston 24 has an axial flange 60 that provides a servo seating surface 62 for the servo member 46. Specifically, in an embodiment where the servo member 46 is a second piston, unlike the servo can, end wall 48 is eliminated thus allowing direct communication between the pressurized fluid port 42 and the first servo piston 24.

In operation, in a first operating condition there is nominal pressure being applied through the first port 42 such that the servo spring 32 biases the first servo piston 24 and servo member 46 against the end wall 36 of the cavity 34 of the end cap 14. Because of the flange 60 engaging the servo member 46 both the head 30 of the first servo piston 24 and the servo member 46 engage end wall 36. Once a first threshold pressure arises via pressurized fluid flowing through the first port 42 the spring force from the servo spring is overcome and the first servo piston 24 and servo member 46 move toward the swashplate 22 until the servo member 46 engages the second seat 58. At the time the servo member 46 engages the second seat 58 the hydraulic unit 10 is in a second operating condition. Then, pressure continues to build against the head 30 of the first servo piston 24 until a second threshold pressure is reached. At this time the first servo piston moves toward the swashplate 22 while the servo member 46 remains at rest against the second seat 58. The first servo piston 24 continues to move toward swashplate 22 until engaging the first seat 40. Upon engaging the first seat 40 the hydraulic unit 10 is in a third operating condition.

In the embodiment of FIGS. 4-6 each operating condition represents a different swashplate angle. Specifically, when there is no pressure or nominal pressure a first speed is presented wherein the swashplate is at a maximum angle condition. In the second condition when a first threshold pressure is met and the servo member 46 engages the second seat 58 a second speed is accomplished at a swashplate displacement between the swashplate minimum and maximum. At a minimum angle condition wherein the second threshold pressure has been reached a third speed is provided. Therefore, three separate and unique operating conditions are present.

Additionally, in this embodiment the first and second threshold pressures may be adjusted depending upon the surface areas of the first and second servo pistons. Similarly, the port 42 may be connected to an external pressure source such as a proportional pressure reducing cartridge or 3-position valve referencing three different pressure sources to provide the needed pressure within the unit 10.

Figure 7:
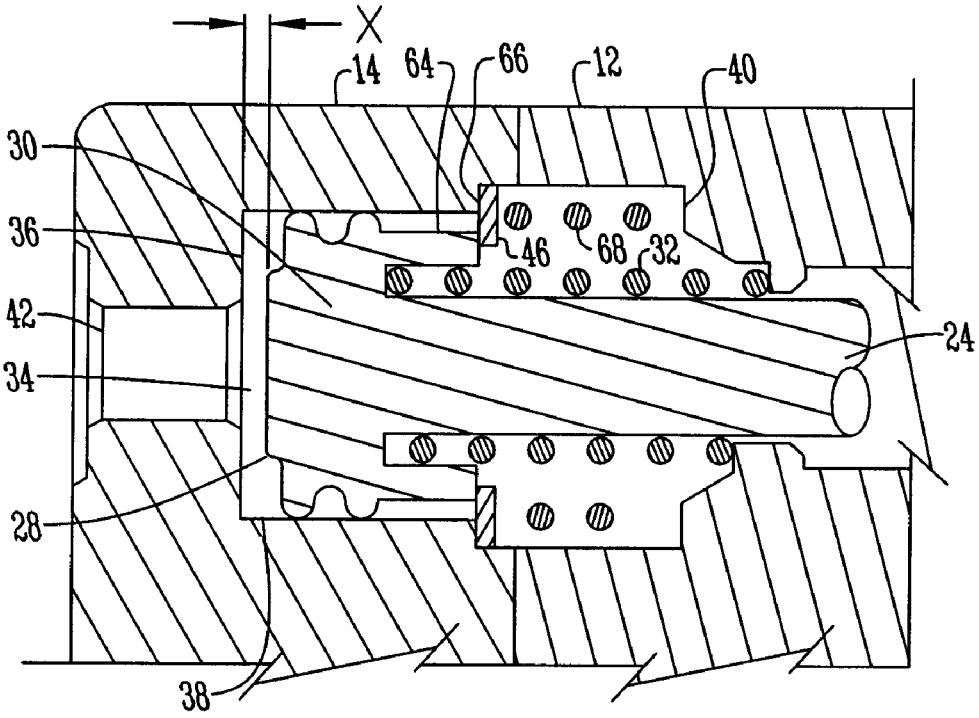
FIG. 7 is a sectional view of a servo piston in an operating condition.
Figure 8:
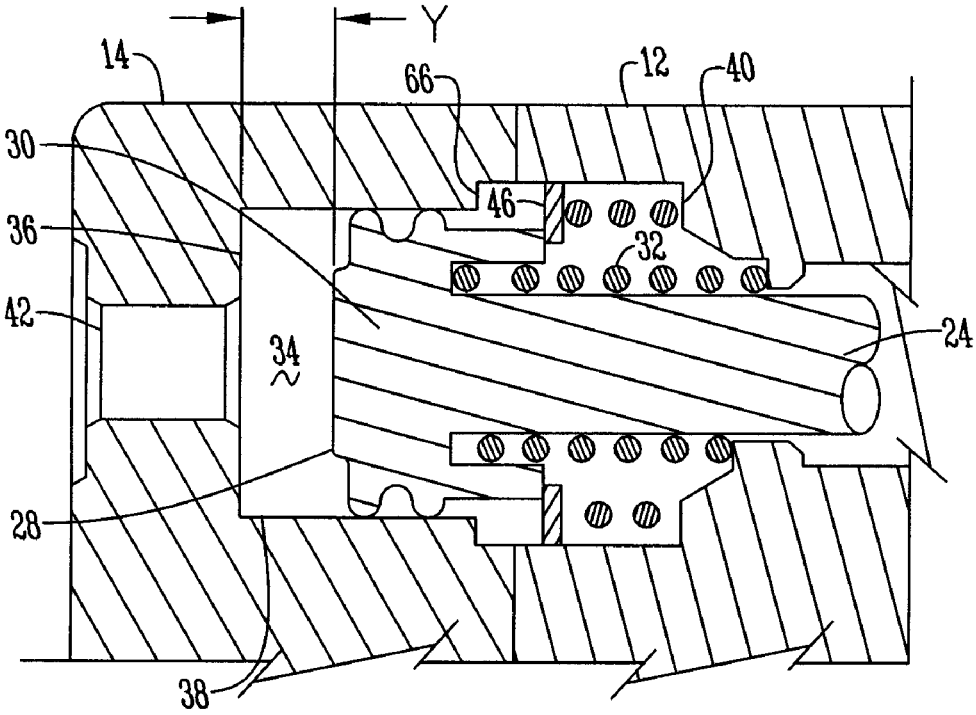
FIG. 8 is a sectional view of a servo piston in an operating condition.
Figure 9:
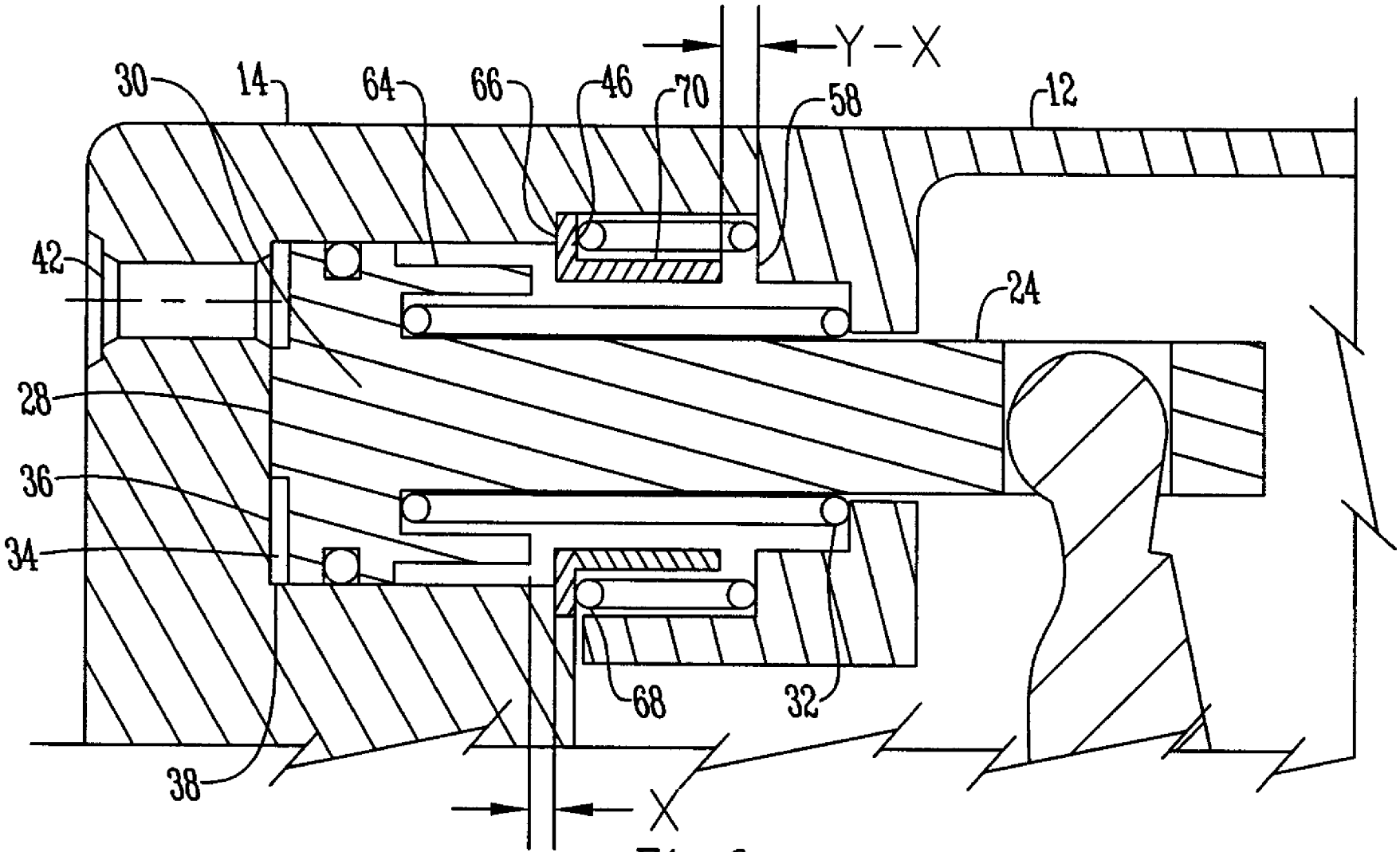
FIG. 9 is a section view of a servo piston in an operating condition.

FIGS. 7-9 show a third embodiment of an axial piston hydraulic device 10. In this embodiment the servo member 46 is an annular ring disposed within the cavity 34 of end cap 14. In this embodiment the head 30 of servo piston 24 has an annular flange 64 that extends from the head 30 toward the first end 26 of the servo piston 24. Additionally, in this embodiment the end cap 14 has an end cap seat 66 upon which the servo member 46 is biased against by an intermediate position spring 68. In an embodiment as seen in FIG. 9 the servo member 46 may further comprise an annular flange 70 extending from the annular ring 66 for engagement with a stop 58 of housing 12. The annular flange 64 of head 30 of servo piston 24 and a servo member 46 surround the servo spring 32.

In operation in a first condition as best shown in FIG. 9 the head 30 of servo piston 24 is biased against the end wall 36 of cavity 34 and end cap 14. Similarly, servo member 46 is biased against the end cap seat 66 with the intermediate position spring 68. As shown a first distance X exists between the annular flange 64 of servo piston 24 and the servo member 46.

When commanded to move from the first condition as shown in FIG. 9 the axial piston hydraulic device 10 provides pressure within fluid port 42 that overcomes servo piston spring 32 to move the piston head 30 away from the end wall 36 of cavity 34. When the piston head 30 moves the first distance X the servo member 46 receives and is engaged by the annular flange 64 of the piston head 30 as best shown in FIG. 7. At this time the pressure from port 42 is not enough to overcome the combination of the spring biasing force of servo spring 32 and the spring biasing force of intermediate position spring 68. As a result the movement of the servo piston 24 and consequently swashplate 22 is stopped at an angle between the maximum angle and minimum angle of the swashplate 22. At this point in time the axial piston hydraulic device is considered in a second condition.

When an axial piston hydraulic device 10 needs to be placed in a third condition additional pressure is provided through pressure port 42 into cavity 34 until the biasing force from servo spring 32 and intermediate position spring 68 is overcome. At this time the piston head 30 and servo member 46 begin to move toward the first end 26 of servo piston 24 such that the servo member 46 disengages from the end cap seat 66 and the piston head 30 moves a second distance Y from the end wall 36 of cavity 34. The piston head 30 and servo member 46 continue to move until either the first end 26 of servo piston 24 engages the stop 27 of housing 12 (see FIG. 1) or the annular flange 70 of servo member 46 engages the second stop 58 of housing 12. (See FIG. 9). In each embodiment when movement of the servo piston head 30 ceases at a position furthest away from end wall 36 of cavity 34 the axial piston hydraulic device is considered in a third condition. The displacement representing the total movement of the servo piston from minimum to maximum displacement from the end wall 36 of cavity 34 is defined as a second distance Y shown in the figures.

While the servo member 46 has been described as an annular ring in one embodiment, the servo member 46 can be any intermediate stop. Specifically, the intermediate stop is preloaded by the intermediate position spring 68 against the end cap 14 with a known preload. Thus, under a first pressure, sufficient force builds between the servo piston 24 and end cap 12 to move the servo piston 24 until the servo piston seats against this intermediate stop. While the force generated by the first pressure is sufficient to overcome the preload provided by servo spring 32, the first pressure is not sufficient to overcome the preload applied by the intermediate position spring 68 and thus the servo piston head seats against the intermediate stop.

Once the shift pressure has been increased to a second greater pressure there is sufficient force to overcome the intermediate position spring 68 biasing force and the servo piston 24 moves in reaction to this force until contacting a stop 27 or 58 of the motor housing 12. Consequently, another embodiment is provided wherein a servo member 46 provides for three position motor functionality in three operating conditions.

Thus, disclosed is an axial piston hydraulic device 10 that uses a servo member 46 to provide a plurality of operating conditions. Specifically, in both a first embodiment when a servo can is used, in a second embodiment when a second servo piston is used and in a third embodiment when an intermediate servo stop is used three operating conditions are present. Therefore, the moveable servo member 46 provides a design to achieve three speed functionality for a swashplate type axial piston unit. By having 3 speeds torque loss is offset by minimizing the high torque travel speeds. Further, with increased displacement accuracy of the swashplate by adding a third position mistracking problems associated with machines such as crawlers and skidsteer loaders is avoided. Consequently, at the very least, all of the stated objectives have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. An axial piston hydraulic device comprising:

a housing having a cylinder block therein with reciprocating pistons that are acted upon by a swashplate;

a first servo piston connected to the swashplate adjacent a first end;

an end cap having a cavity disposed therein secured to the housing; and a moveable servo member disposed within the cavity of the end cap and receiving the servo piston to provide at least three operating conditions;

wherein a servo fill port is disposed within the servo member to provide pressure within a cavity of the servo member; and wherein the end cap has a first port to pressurize the cavity of the end cap and a second port in communication with the servo fill port to pressurize the cavity of the servo member;

wherein a biasing member biases the servo member and servo piston to a first position;

wherein pressurization of the first port to a first threshold pressure moves the servo member and servo piston a first distance from the first position;

wherein pressurization of the second port to a second threshold pressure moves the servo piston a second distance from the first position; and wherein the first distance is less than the second distance.

2. The device of claim 1 wherein when the swashplate is at a maximum angle a first operating condition is provided; when movement of the swashplate is ceased at an angle between the maximum angle and a minimum angle a second operating condition is provided; and when the swashplate is at the minimum angle a third operating condition is provided.

3. The device of claim 1 wherein the servo member is a servo can having a cylindrical shape.

4. The device of claim 1 wherein the servo member is a servo stop.

5. An axial piston hydraulic device comprising:

a housing having a cylinder block therein with reciprocating pistons that are acted upon by a swashplate;

a servo piston connected to the swashplate adjacent a first end;

an end cap having a cavity disposed therein secured to the housing; and a moveable servo can having a sidewall extending from an end wall disposed within the cavity of the end cap and receiving the servo piston to provide at least three operating conditions wherein the end cap has a first port in communication with the cavity of the end cap to provide pressure within the cavity of the end cap; and wherein the end cap has a second port in communication with a servo fill port disposed within the servo can to provide pressure within a cavity of the servo can;

wherein a biasing member biases the servo member and servo piston to a first position;

wherein pressurization of the first port to a first threshold pressure moves the servo member and servo piston a first distance from the first position;

wherein pressurization of the second port to a second threshold pressure moves the servo piston a second distance from the first position; and wherein the first distance is less than the second distance.

6. The device of claim 5 wherein the end wall of the servo can engages an end wall of the cavity of the end cap and the servo piston engages the end wall of the servo can in a first operating condition.

7. The device of claim 6 wherein the servo can moves to engage a seat to move the first distance in a second operating condition.

8. The device of claim 7 wherein the servo piston moves to engage a stop to move the second distance in a third operating condition.

* * * * *